US005180130A

United States Patent [19]

McMichael

[11] Patent Number: 5,180,130

[45] Date of Patent: Jan. 19, 1993

[54] SUPPORTING BRACKET AND HEADRAIL COMBINATION FOR A WINDOW BLIND

[75] Inventor: Dannie L. McMichael, West Kingston, R.I.

[73] Assignee: Kenney Manufacturing Company, Warwick, R.I.

[21] Appl. No.: 618,111

[22] Filed: Nov. 26, 1990

[51] Int. Cl.[5] ..... E06B 9/38

[52] U.S. Cl. ..... 248/251; 160/178.2; 160/902; 248/221.3

[58] Field of Search ..... 16/94 D, 94 R; 160/178.1, 902; 248/222.1, 221.4, 221.3, 251, 254, 262, 267, 542, 544

[56] References Cited

U.S. PATENT DOCUMENTS

| | | | |
|---|---|---|---|
| 1,356,675 | 10/1920 | Weir | 248/251 |
| 1,553,132 | 9/1925 | Bertrand | 248/251 |
| 1,805,611 | 5/1931 | Burns | 248/264 |
| 1,822,890 | 9/1931 | Heymer | 248/264 |
| 1,845,857 | 2/1932 | Ward | 160/25 |
| 1,917,416 | 7/1933 | Zingg | 160/176.1 |
| 1,992,148 | 2/1935 | Hammer | 248/264 |
| 2,060,720 | 11/1936 | Beauchamp | 16/94 R |
| 2,138,502 | 11/1938 | Nordstrom, Jr. et al. | 248/264 |
| 2,203,372 | 6/1940 | Trammell | 160/38 |
| 2,247,260 | 6/1941 | Stone | 160/84.1 |
| 2,281,043 | 4/1942 | Nelson | 248/264 |
| 2,367,322 | 1/1945 | Wright et al. | 248/262 |
| 2,674,432 | 4/1954 | Lorentzen | 248/264 |
| 2,698,727 | 1/1955 | Rutledge | 248/264 |
| 2,808,222 | 10/1957 | Wassyng et al. | 248/262 |
| 3,169,006 | 2/1965 | Lorentzen et al. | 248/262 |
| 4,141,525 | 2/1979 | Miller | 248/251 |
| 4,224,974 | 9/1980 | Anderson et al. | 160/178.1 |
| 4,235,406 | 11/1980 | Vecchiarelli | 248/251 |
| 4,411,401 | 10/1983 | Anderson | 248/262 |
| 4,475,706 | 10/1984 | Anderson | 248/542 |
| 4,531,563 | 7/1985 | Nilsson | 160/168.1 |
| 4,607,677 | 8/1986 | Comeau | 160/84.1 |
| 4,607,818 | 8/1986 | Georgopoulos | 248/251 X |
| 4,802,644 | 2/1989 | Oskam | 248/251 |
| 4,840,216 | 6/1989 | John | 160/178.1 |
| 4,919,185 | 4/1990 | Comeau | 160/178.1 |
| 4,938,443 | 7/1990 | Rowe | 248/251 |
| 4,949,926 | 8/1990 | Liu | 248/251 |
| 4,957,255 | 9/1990 | John | 248/222.3 |

FOREIGN PATENT DOCUMENTS

| | | | |
|---|---|---|---|
| 13172 | of 1892 | United Kingdom | 160/902 |
| 915588 | 1/1963 | United Kingdom . | |
| 1014927 | 12/1965 | United Kingdom . | |

*Primary Examiner*—Carl D. Friedman
*Assistant Examiner*—Derek J. Berger
*Attorney, Agent, or Firm*—Richard A. Inz

[57] ABSTRACT

This invention relates to a headrail and mounting bracket for retractable venetian window blinds. The bracket has a top plate and a rear plate extending downwardly from the top plate. A hook near one end of the top plate engages with a lip on a front wall of the headrail. Means are provided to ensure that the hook is securely and tightly engaged with the lip. A latch associated with the rear plate engages with the rear edge of the bottom wall of the headrail to secure the headrail in the bracket. An end plate may also be provided on the bracket.

3 Claims, 2 Drawing Sheets

FIG. 4
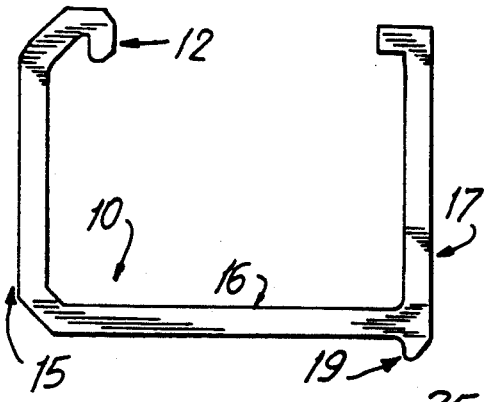
FIG. 5
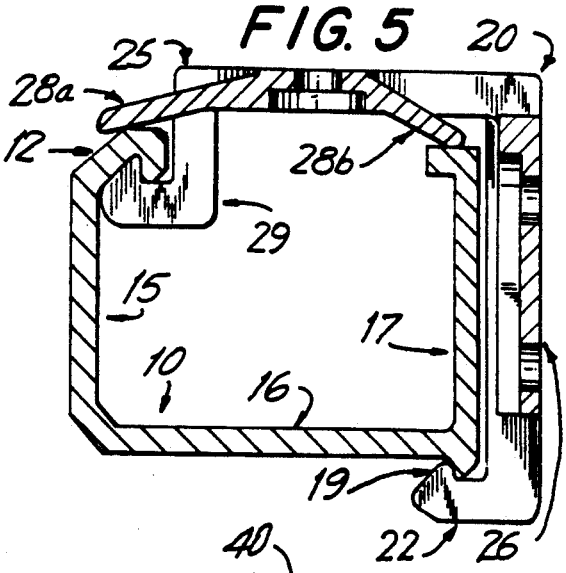
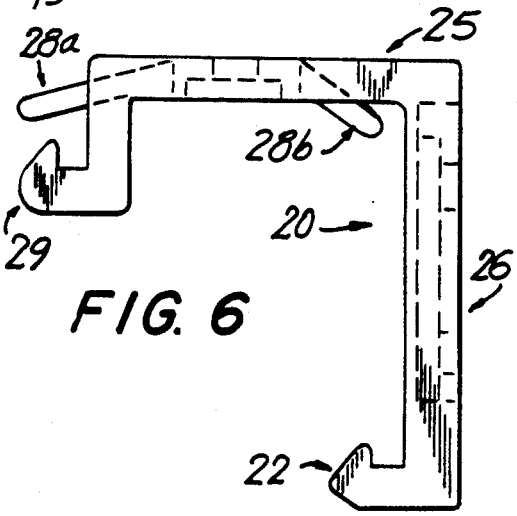
FIG. 6
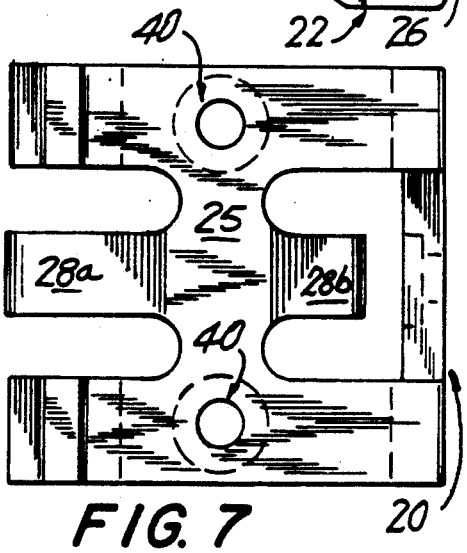
FIG. 7
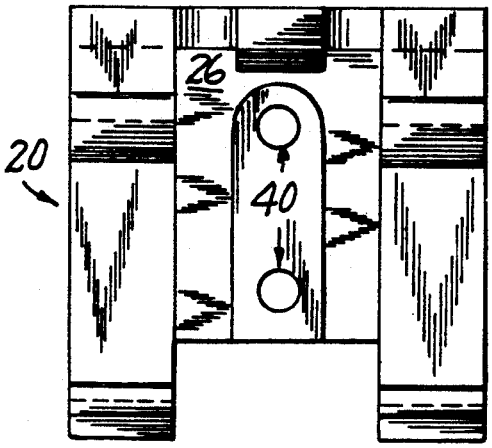
FIG. 8
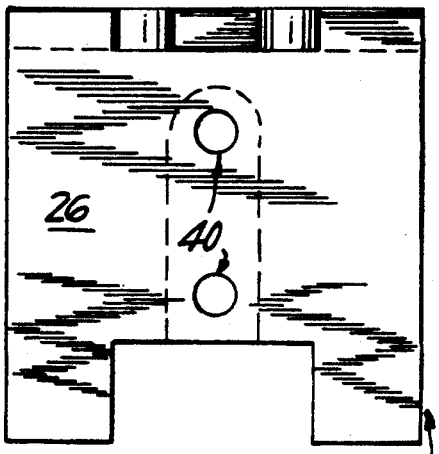
FIG. 9

SUPPORTING BRACKET AND HEADRAIL COMBINATION FOR A WINDOW BLIND

BACKGROUND OF THE INVENTION

Present headrails for retractable venetian window blinds are generally U-shaped channels which are mounted in a window opening by attachment either to the face of the window frame, by an end mount to the inner walls of the window casing, or by an overhead mount to the upper wall of the casing or the ceiling adjacent to the window. In order to mount the headrail in any one of these three ways, cup-shaped brackets have been generally provided which fit onto either end of the headrail. These brackets generally have screw holes in them positioned for each of the three mounting configurations and are adapted also to fit around the headrail to support it from below and to prevent it from tilting.

Among the drawbacks of such conventional headrails and brackets are that the brackets present an unattractive enlarged portion at each end of the headrail and, in cases where the headrail is mounted on the face of the window frame, the ends of the brackets present a view of unsightly screw holes. In addition, the draw cords and slat adjusting mechanisms employed for such headrails are brought out at an angle to the front of the headrail through the front face thereof. As a result, an extra valance strip must be attached along the front face of the headrail to present a smooth and clean appearance for the face of the headrail. This requires both additional material costs and the requirement of carrying extra inventory.

Two means of overcoming the above-described deficiencies are disclosed in commonly-assigned U.S. Pat. No. 4,919,185 and commonly-assigned, co-pending U.S. patent application Ser. No. 07/389,288 filed on Aug. 2, 1989, now abandoned. The inventions of both U.S. Pat. No. 4,919,185 and U.S. patent application Ser. No. 07/389,288 disclose a headrail and bracket combination.

In U.S. Pat. No. 4,919,185, the bracket has a top plate having a hook means for engaging a support lip on the front wall of the headrail, a rear ledge means for engaging the lower edge of the rear wall of the headrail and a ramp means extending from the top plate of the bracket for engaging the upper edge of the rear wall of the headrail. When the headrail is engaged in the bracket, the ramp means urges the upper edge of the rear wall of the headrail rearwardly to pull the support lip on the front wall of the headrail into tight engagement with the hook means of the bracket.

In U.S. patent application Ser. No. 07/389,288, the bracket has a hook means for engaging a support lip on the front wall of the headrail, a rear ledge means for engaging the lower edge of the rear wall of the headrail and a leg means for urging the top plate upward to ensure that the hook means is pushed into tight engagement with the support lip on the front wall of the headrail.

Each of these headrail and bracket combinations is an improvement over the cup-shaped brackets and headrails previously used. However, although the brackets of U.S. Pat. No. 4,919,185 and U.S. patent application Ser. No. 07/389,288 securely support the headrail, they may be somewhat difficult to engage with the headrail.

It would be desirable to provide a supporting bracket and headrail for retractable venetian window blinds in which the brackets are adapted for mounting in any one of the three conventional positions and which, at the same time, avoid presenting to view enlarged end brackets or screw holes.

It would also be desirable to provide a supporting bracket and headrail which provide a smooth, substantially uninterrupted surface for the face and ends of the headrail and thereby avoid the need for a valance strip, providing a reduction of materials and inventory requirements.

It would still further be desirable to provide a supporting bracket and headrail in which the headrail is simple to insert into the supporting bracket.

SUMMARY OF THE INVENTION

It is therefore an object of the invention to provide a supporting bracket and headrail for retractable venetian window blinds in which the brackets are adapted for mounting in any one of the three conventional positions, and which, at the same time, avoid presenting to view enlarged end brackets or screw holes.

It is another object of the invention to provide a supporting bracket and headrail which provide a smooth, substantially uninterrupted surface for the face and ends of the headrail.

It is still another object of the invention to provide a supporting bracket and headrail in which the headrail is simple to insert into the supporting bracket.

In accordance with this invention, there is provided a bracket having a top plate and a rear plate extending downwardly from one end of the top plate. A hook means associated with the top plate engages a lip on the front wall of the headrail. Means are provided for urging the hook into engagement with the lip. A latch means associated with the rear or top plate engages the rear edge of the bottom wall of the headrail. The hook and latch means ensure that the headrail is releasably locked into position in the bracket without interfering with the mounting of the bracket to a surface. The means for urging the hook into engagement with the lip are flexible and allow for easy insertion of the headrail into the bracket. This structure also avoids presenting unsightly bracket surfaces and screw holes to view, and allows draw cords and slat adjusting mechanisms to be brought out through the bottom surface of the headrail at the position of the bracket. An end plate may also be provided on the bracket.

BRIEF DESCRIPTION OF THE DRAWINGS

The above and other objects and advantages of this invention will be apparent upon consideration of the following detailed description, taken in conjunction with the accompanying drawings, in which like reference characters refer to like parts throughout, and in which:

FIG. 4 is a side elevation view of the headrail of this invention;

FIG. 5 is an side elevation, cross-sectional view of the headrail and bracket combination of this invention;

FIG. 6 is a side elevation view of the bracket of this invention;

FIG. 7 is a top plan view of the bracket of this invention;

FIG. 8 is a front elevation view of the bracket of this invention; and

FIG. 9 is a rear elevation view of the bracket of this invention.

DETAILED DESCRIPTION OF THE INVENTION

Figure 1:
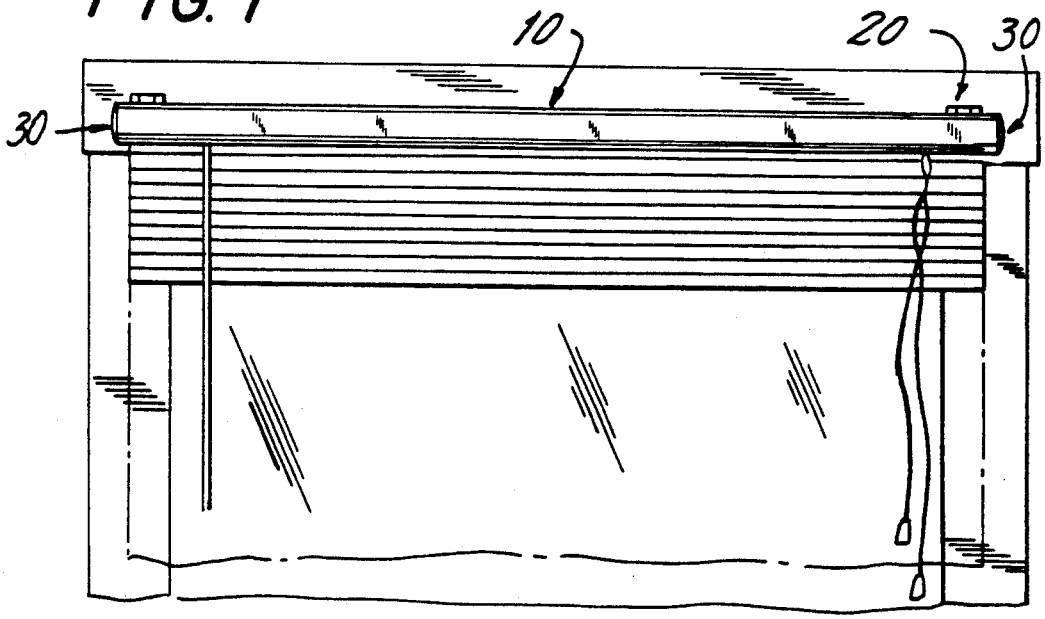
FIG. 1 is a front elevation view of the headrail and bracket combination of the invention mounted on a window frame and supporting a venetian blind.
Figure 2:
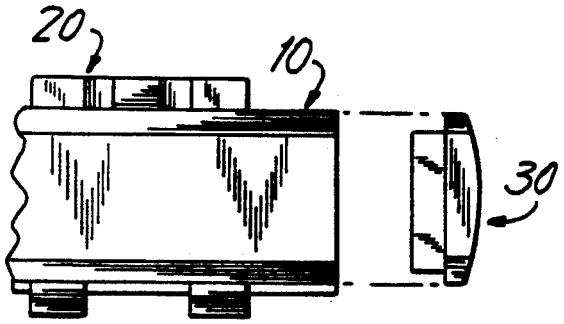
FIG. 2 is a partial front elevation view of the bracket, a portion of the headrail and an end cap which can be inserted in the headrail of this invention.
Figure 3:
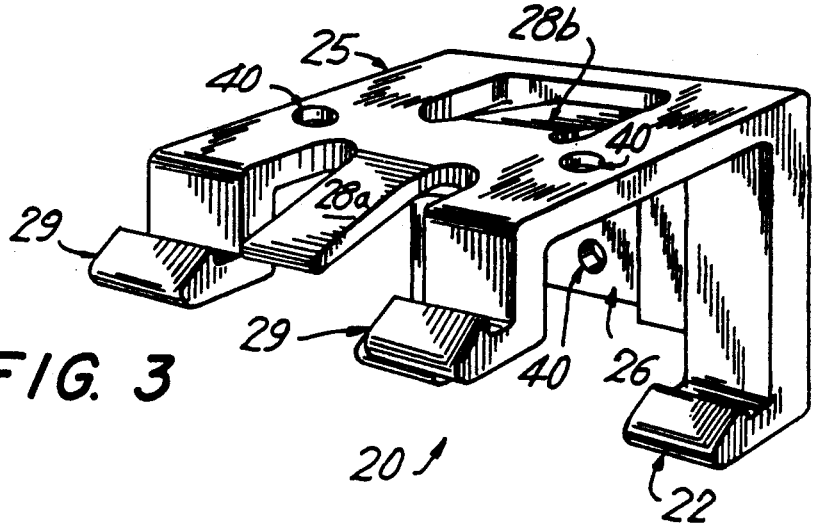
FIG. 3 is a perspective view of the bracket of this invention.

The headrail 10 has a generally U-shaped configuration with a front wall 15, a bottom wall 16 and a rear wall 17. Front wall 15 has a rearwardly extending lip 12 adjacent to the upper surface thereof. The rear edge of bottom wall 16 may be provided with a downwardly extending ledge 19. Headrail 10 is preferably fabricated as a unitary extrusion of high resistance polyvinyl chloride, but other materials, such as cold rolled steel, are also suitable.

One or more brackets 20 may be used in conjunction with headrail 10 for mounting to a window opening and for supporting a covering, such as venetian blinds, for the window. Bracket 20 of this invention is adapted to support one or the other end of headrail 10 as well as any length of headrail 10.

Bracket 20 comprises a top plate 25 having a front edge and a rear edge, and a rear plate 26 extending downwardly from the rear edge of top plate 25. An end plate (not shown but see U.S. Pat. No. 4,919,185) may also be provided on either side of bracket 20 depending upon which end of headrail 10 bracket 20 will support. Alternatively, no end plate may be used if bracket 20 is used to support headrail 10 along its interior length, or in an installation at the end of headrail 10 where no end plate is needed. The end plate may be connected to rear plate 26 or top plate 25. Preferably, the end plate is connected to rear plate 26. The connection between the end plate and rear plate 26 has a relatively narrow cross-section as compared to the cross-section of rear plate 26 or is otherwise weakened to facilitate the removal of the end plate from rear plate 26. Bracket 20 may be made of frangible material, such as ABS (acrylonitrile butadiene styrene), when it is desired to allow for the removal of the end plate. However, bracket 20 is preferably made of a stiff but flexible material such as polycarbonate to allow the end plate to be bent out of sight or for mounting to a surface at an angle.

Top plate 25 is provided with one or more hook means 29 adjacent to its front edge. Hook means 29 are adapted to engage lip 12 of front wall 15. Securing means **28*a* and 28*b* for urging hook means 29 into tight and secure engagement with lip 12** are provided.

Securing means **28*a* and 28*b* extend downwardly from top plate 25. When headrail 10 is inserted into bracket 20, securing means 28*a* contacts the top of front wall 15 and securing means 28*b* contacts the top of rear wall 17 of headrail 10. Securing means 28*a* and 28*b* are flexible because of the preferred material from which bracket 20 is made. This flexibility allows securing means 28*a* and 28*b* to flex up when headrail 10 is first inserted in bracket 20 and then urge top plate 25 upwardly and ensure that hook means 29 are pushed into tight and secure engagement with lip 12 after headrail 10 is completely inserted in bracket 20. To ensure that lip 12 is securely engaged in hook means 29, securing means 28*a* and 28*b* should extend down from top plate 25 at an angle that will allow securing means 28*a* to contact the top of front wall 15 and that will allow securing means 28*b* to contact the top of rear wall 17**.

Bracket 20 is also provided with one or more latch means 22. Latch means 22 may extend down from top plate 25 but are preferably associated with rear plate 26. Latch means 22 engage with the rear edge of bottom wall 16. When headrail 10 is rotated into bracket 20, hook means 29 are pushed into engagement with lip 12 and latch means 22 are pushed into engagement with the rear edge of bottom wall 16. Headrail 10 is releasably locked into bracket 20 in this position. Headrail 10 will remain in the locked position until latch means 22 are released out of engagement with the rear edge of bottom wall 16. Preferably latch means 22 engage a ledge 19 extending along the rear surface of bottom wall 16. Ledge 19 thus interlocks with latch means 22 when headrail 10 is rotated into bracket 20.

Alternatively, instead of using rear ledge 19, rear wall 17 may be configured to interlock with latch means 22 when headrail 10 is rotated into bracket 20.

Headrail 10 is supported on bracket 20 solely by hook means 29 and latch means 22. The end plate does not contribute to the support. Thus the end plate can be removed and the remaining components of bracket 20 can be used as a center support in cases where headrail 10 has a long main body portion. Each of the top, rear and end plates is provided with holes 40 to allow bracket 20 to be screwed, nailed or otherwise attached to a window opening.

In order to provide a smooth and decoratively pleasing appearance for the end of headrail 10 when it is mounted on the face of the window frame or to an overhead surface, end caps 30 may be provided. End caps 30 are dimensioned to fit into an open end of headrail 10. In addition, front wall 15 may be given a rounded, beveled or other decorative contour. Furthermore, the pull cords for the blind and the slat adjusting element can be installed either in bottom wall 16 entirely or with only a small interruption of the continuous surface of front wall 15 along the lower forward edge of bottom wall 16.

Thus it is seen that a headrail and bracket combination is provided which performs all of the necessary functions of a headrail and at the same time presents a sufficiently clean, smooth and uninterrupted surface to obviate the necessity for the application of a valance strip. This design also facilitates insertion and removal of the headrail from the bracket. One skilled in the art will appreciate that the present invention can be practiced by other than the described embodiments, which are presented for purposes of illustration and not of limitation, and the present invention is limited only by the claims which follow.

What is claimed is:

1. A headrail and mounting bracket combination, comprising:

a generally U-shaped member having a front wall, a bottom wall having a front edge and a rear edge, and a rear wall;

said rear wall extending upwardly from said rear edge of said bottom wall and having a lower edge;

said front wall extending upwardly from said front edge of said bottom wall and having a lip portion extending toward said rear wall;

unitary bracket means for supporting said generally U-shaped member having a top plate and a rear plate connected to said top plate;

hook means associated with said top plate for engagement with said lip portion of said front wall;

securing means extending down from said top plate against the top of said front wall and against the top of said rear wall for urging said hook means into secure engagement with said lip portion; and latch means associated with said bracket means for engagement with said rear edge of said bottom wall or said lower edge of said rear wall of said generally U-shaped member.

2. The headrail and mounting bracket combination of claim 1 wherein said bracket means is formed from resilient material.

3. The headrail and mounting bracket combination of claim 2 wherein said bracket means is formed from polycarbonate.

* * * * *

UNITED STATES PATENT AND TRADEMARK OFFICE

CERTIFICATE OF CORRECTION

PATENT NO. : 5,180,130

DATED : January 19, 1993

INVENTOR(S) : Dannie L. McMichael

It is certified that error appears in the above-identified patent and that said Letters Patent is hereby corrected as shown below:

In claim 2, line 2, after "from" insert -- a --.

Signed and Sealed this

Nineteenth Day of April, 1994

Bruce Lehman

*Attest:*

BRUCE LEHMAN

*Attesting Officer*

*Commissioner of Patents and Trademarks*